United States Patent [19]

Drake

[11] 4,148,430

[45] Apr. 10, 1979

[54] BUSINESS FORM

[75] Inventor: Terrance L. Drake, San Diego, Calif.

[73] Assignee: Innovative Business Forms, Inc., El Cajon, Calif.

[21] Appl. No.: 800,295

[22] Filed: May 25, 1977

[51] Int. Cl.[2] ..... B65D 27/10; B65D 27/06

[52] U.S. Cl. ..... 229/69; 229/73; 229/92.3

[58] Field of Search ..... 229/68 R, 73, 69, 92.3; 281/3 R; 283/56

[56] References Cited

U.S. PATENT DOCUMENTS

| | | | |
|---|---|---|---|
| 1,114,920 | 10/1914 | Seeligson | 229/68 R |
| 3,507,519 | 4/1970 | McNobb | 229/69 |
| 3,560,025 | 2/1971 | Ostrander | 229/68 R |
| 3,863,835 | 2/1975 | Gendron | 229/92.3 |
| 3,899,381 | 8/1975 | O'Brien et al. | 229/68 R |
| 3,952,942 | 4/1976 | O'Leary et al. | 229/73 |

FOREIGN PATENT DOCUMENTS

| | | | |
|---|---|---|---|
| 1484517 | 6/1967 | France | 229/69 |

*Primary Examiner*—Stephen P. Garbe
*Attorney, Agent, or Firm*—John L. Haller

[57] ABSTRACT

A new business form having integral therewith a mailing envelope, a customer statement, and a return envelope. The new business form includes an outer sheet having a releasable bisecting center line dividing the outer sheet into and forming thereby a first side and a second side, and an inner sheet which is secured to the first side along three edges thereof to form the return envelope. The second side is adapted to receive customer information and function as the customer statement. The outer sheet is folded on the bisecting center line and releasably attached along the outer edges of mating surfaces of the first side and the second side to form the mailing envelope. The improved business form may be one of a continuous series of improved business forms which are adapted for use on high speed data processing equipment.

3 Claims, 17 Drawing Figures

BUSINESS FORM

BACKGROUND OF THE INVENTION

1. Field of the Invention

This invention relates to a new and unique business form which includes a mailing envelope, a customer statement and return envelope. Business forms of this type are generally used for business correspondence where a return mailing, such as payment, is anticipated. Frequently, where high volume mailings are required, such business forms are manufactured in a continuous series for statement preparation on data processing equipment.

2. Brief description of the Prior Art

Conventional business forms generally included a separate mailing envelope, separate insert material, separate customer statement, and when required, a separate return envelope. Frequently, such materials are individually prepared, with possibly the customer statement being prepared on data processing equipment, and usually individually inserted into the mailing envelope for distribution to the customer. Recently, with the advent of data processing equipment, forms have been developed which are adapted for automatic preparation.

U.S. Pat. No. 3,339,827 disclosed a business form which includes a pre-sealed mailing envelope and enclosed business records. Similarly, U.S. Pat. No. 3,608,816 disclosed a series of detachable envelopes, suitable for data processing equipment, each of which include an envelope and insert material. While both of these patents disclose fabricated business forms which are suitable for preparation on data processing equipment, they require multiple layers of pre-printed sheets to form mailing envelopes and customer statements. Further, because the mailing envelopes are pre-sealed, the only method by which the customer statement information can be imparted to the customer statement is through some form of impact printing technique, such as carbon backing on the under side of an interior sheet which transmits the customer information to the customer statement sheet when run through conventional printers. Additionally, neither of these patents disclose a device which provides an integral return envelope.

U.S. Pat. No. 3,507,519 discloses a business form which includes a mailing envelope, a return envelope and a customer statement which has a customer stub and return stub. This form consists of two sheets, in full registry, which are secured along the outer edges of the mating surfaces of their opposing sides. An array of gluing lines and tear perforations provide the customer statement and return envelope. Customer statement information is imparted to the statement through impact printing such as a transfer carbon on an interior sheet.

The form disclosed in U.S. Pat. No. 3,507,519 requires the top and bottom sheets to be secured (glued) along their side edges then transversely folded along a center tear perforation line to form the mailing envelope. Inherent to this form is a problem commonly referred to as tenting. Tenting occurs where a fold is applied along a line which separates securing means (such as gluing) on either side of the fold line. The tenting problem, a bulge in bottom sheet, results from the different length taken by the top and bottom sheets during the fold operation and the inability of the two sheets to adjust to this difference in length.

Further, there is no provision for direct printing of the statement information, which frequently results in illegible or obscure statement information. A further disadvantage of the aforesaid form is that the transversely oriented cross tear perforation line on which the form is transversely folded to form the mailing envelope is susceptible to separation during the bursting operation separating the individual forms.

SUMMARY OF THE INVENTION

The present invention relates to an improved business form having therein a mailing envelope, a customer statement, and return envelope. The improved business form includes an outer sheet with a longitudinal-releasable-bisecting center line dividing said outer sheet into and forming thereby a first side and a second side. The second side is adapted to accept direct printing of statement information to form the customer statement. An inner sheet is attached to the first side of the outer sheet and secured along three edges thereof to form the return envelope. The outer sheet with attached inner sheet is longitudinally folded along the center line with the outer edges of the mating surfaces of the first side and the second side being releasably secured to form the mailing envelope.

The improved business form may be constructed in a series of individual forms for statement preparation on data processing equipment. In such an embodiment, the outer sheet and attached inner sheet are provided with transverse tear perforations or lines of weakening which allow the separation of the individual forms. The first side of said outer sheet may be provided with a sending die-cut opening whereby the customer name and address, which is part of the customer statement information provided on the customer statement, is visible through said sending opening of the folded mailing envelope.

Upon receipt of the improved business form, the customer separates the first side from the second side, examines the statement information, and returns appropriate material, such as a payment, in the pre-addressed return envelope.

An embodiment of this invention provides a copy statement by means of an enlarged inner sheet which is adapted to customer requirements of size, shape, paper or print. The enlarged inner sheet, extending beyond the bisecting center line, covers the second side, and is secured to the first side in the manner rquired to form the return envelope. The enlarged inner sheet further includes, in approximate registry with the bisecting center line, a longitudinal-releasable-line which allows for the separation of the copy statement.

It is an object of this invention to provide an improved business form which includes an integral mailing envelope, a customer statement, and return envelope. A further object of this invention is to provide an improved business form which allows for the direct printing of statement information. It is a further object of this invention to provide an improved business form which avoids the tinting phenomenom associated with a folded form. A further object of this invention is to provide an improved business form with integral mailing envelope, customer statement, and return envelope which can be economically produced and easily used, and which can accommodate special size, shape and print requirements for the customer statement. A further object of this invention is to provide an improved business form with integral mailing envelope, customer statement, which is adapted for direct printing of statement information, and return envelope constructed of a single inner sheet. A further object of this invention is to provide an improved business form which is adapted for preparation on automatic data processing equipment.

BRIEF DESCRIPTION OF THE DRAWINGS

The above objects and features of my improved business form will become more apparent in conjunction with the following description and accompanying drawings, which are.

DESCRIPTION OF THE PREFERRED EMBODIMENT

Figure 1:
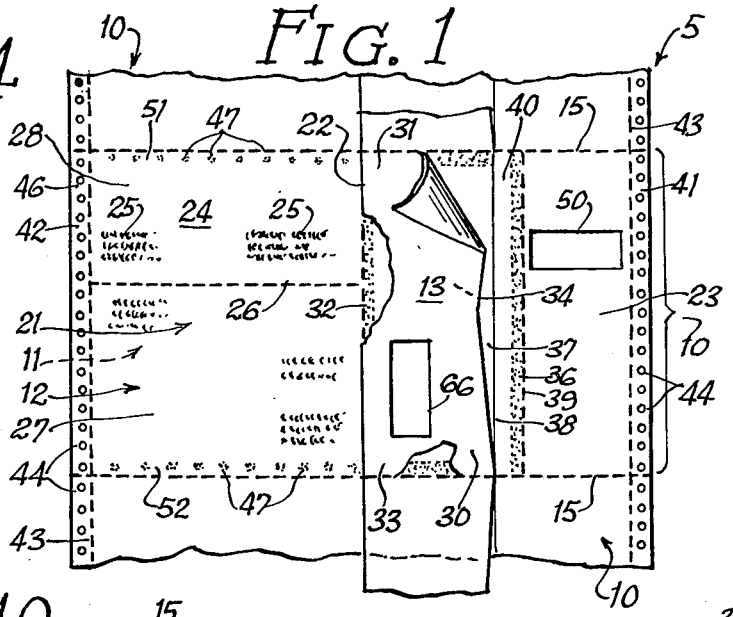
FIG. 1 is a plan view of the improved business form shown in a broken section of a continuous series of improved business forms.

Referring to FIG. 1, the preferred embodiment of my invention is an improved business form 10 which includes a mailing envelope 11, a customer statement 12 and a return envelope 13. The improved business form 10 is manufactured in a continuous series 5 of individual business forms 10, each individual business form 10 being delimited by transverse lines of weakening 15.

The improved business form 10 is comprised of an outer sheet 21 having a longitudinal bisecting center line of weakening 22 whereby a first side 23 and a second side 24 are formed. The bisecting center line 22 is continuous through the entire continuous series 5 of individual business forms 10. The second side 24 is adapted to receive direct printing of customer information 25 in an appropriate format whereby to form the customer statement 12. The second side 24 is further provided with a statement line of weakening 26 which delimits a customer stub 27 from a return stub 28.

The improved business form 10 further includes a longitudinally oriented inner sheet 30 which is continuous through the entire continuous series 5 of individual business forms 10, and whereby the lines of weakening 15 extends through said inner sheet 30. The inner sheet 30, confined to the first side 23 of the outer sheet 21, extends from the top edge 31 of the improved business form 10 to the bottom edge 33. The inner sheet 30 has the center edge 32 which is parallel to and adjacent to the bisecting center line 22, and is adhesively secured to the outer sheet 21 along the top edge 31, center edge 32, and bottom edge 33, leaving the remaining edge 37 open and forming a pocket 34 between the inner sheet 30 and the outer sheet 21.

Figure 2:
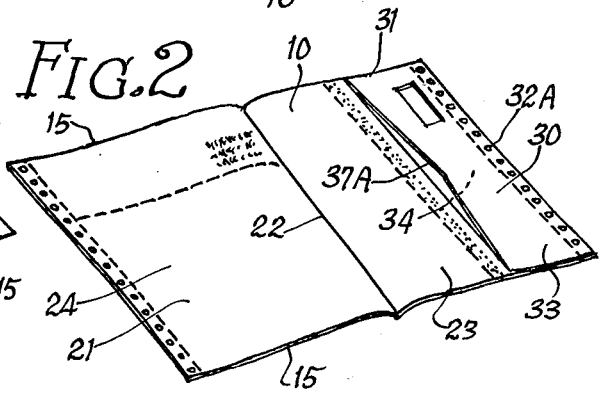
FIG. 2 is a perspective view of an alternate embodiment, showing the return envelope on the outside of the first side.

An alternative orientation of the inner sheet 30 is shown in FIG. 2 whereby the inner sheet 30 extends from the top edge 31 to the bottom edge 33 and whereby the inner sheet 30 has one edge parallel to and adjacent to the outer edge 32A of the first side 23. The inner sheet 30 is secured to the outer sheet 31, outer edge 32A and bottom edge 33 leaving the inner edge 37A open to form a pocket 34 between the inner sheet 30 and the outer sheet 21.

Referring back to FIG. 1, the first side is further provided with a return envelope sealing flap 40. The sealing flap includes a longitudinally oriented return line of weakening 36 which is parallel to and which is positioned outside the remaining edge 37 of the inner sheet 21, a longitudinally oriented score line 38 which is parallel to and which is positioned at the remaining edge 37, and a return adhesive strip 39 which is positioned intermediate the score line 38 and the return line of weakening 36. The adhesive material considered best for the strip 39 is a remoist glue manufactured by Stein Hall and known as Flash Seal.

Figure 4:
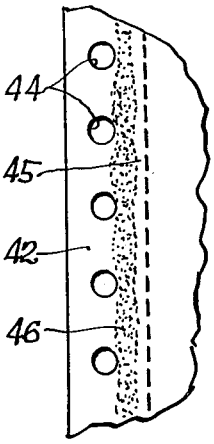
FIG. 4 is a broken plan view of the second feed strip.
Figure 3:
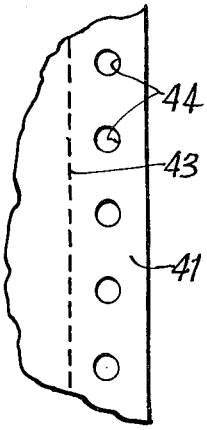
FIG. 3 is a broken plan view of the first feed strip.

The outer sheet 21 is further provided with a first feed strip 41 (see FIG. 3) and a second feed strip 42 (see FIG. 4). Both the first feed strips 41 and the second feed strips 42 are continuous through the continuous series 5 of improved forms 10. Both feed strips have strip lines of weakening 43 and a plurality of feed holes 44 adapted for operation with data processing equipment.

The outer sheet is provided with a mailing adhesive strip 46, positioned within the second feed strip 42, and a plurality of releasable adhesive spots 47, evenly distributed along the upper edge 51 and lower edge 52 of the second side 24 of the outer sheet 21. The adhesive material considered best for the mailing adhesive strip 46 and spots 47 is a reheat glue manufactured by Swift and known as #2518.

Rather than the adhesive spots 47, the outer sheet 21 may be provided with an upper and lower adhesive strip (not shown) which includes an upper and lower line of weakening (not shown), and an adhesive material (not shown) positioned within the upper and lower strips.

Figure 14:
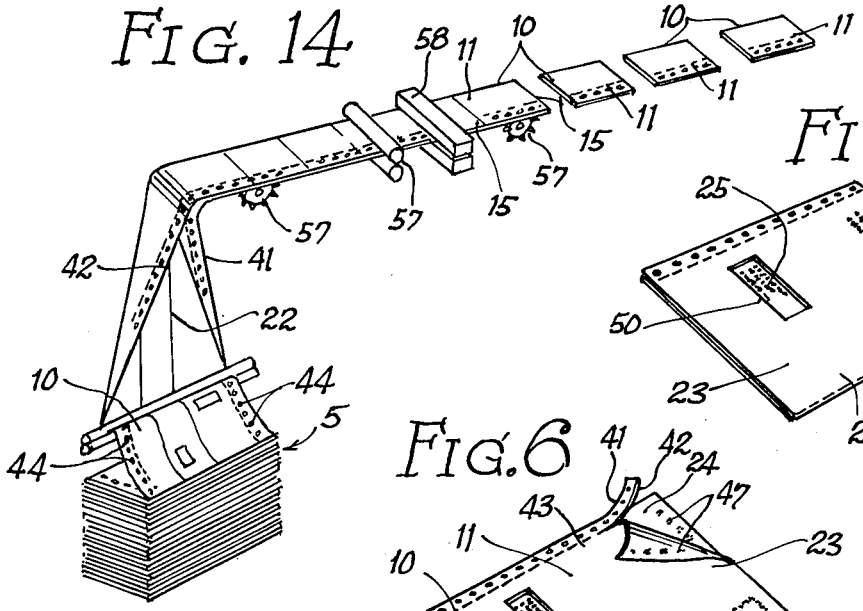
FIG. 14 is a perspective view showing a continuous series of improved business forms being folded, attached, and separated.

As is shown in FIG. 14, the continuous series 5 of individual business forms 10, having been prepared by appropriate data processing equipment is longitudinally folded along the bisecting center line 22 such that the feed holes 44 of the first feed strip 41 align with the feed holes 44 of the second feed strip 42. The folded continuous series 5 is fed by advancing means 57 through an adhesive activator 58. The adhesive activator 58 heats the business form 10 to activate the reheat glue of the mailing adhesive strip 46 and spots 47 to seal the mailing envelope 11. A device which is suitable for this operation is manufactured by Moore Business Forms, Inc. and known as the Model 812 Speedisealer.

Each of the individual business forms 10 in the sealed continuous series 5 of individual business forms 10 is separated at the lines of weakening 15 through conventional bursting means forming thereby the separate individual business forms 10.

Figure 5:
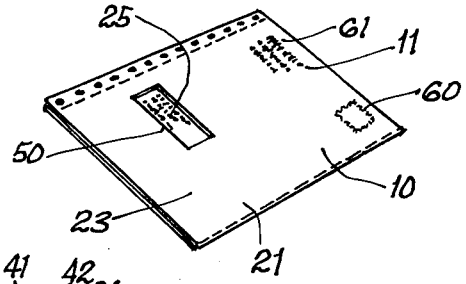
FIG. 5 is a perspective view of a single mailing envelope.

FIG. 5 shows an individual business form 10 which is ready for mailing. The business form 10 includes a preprinted postal stamp 60, and a return address 61; alternatively, the return address and postal stamp may be applied by other means such as secondary die-cut openings, manual stamping, gum labels or remoist stamps.

As shown in FIG. 5 and FIG. 1, the first side 23 of the outer sheet 21 is further provided with a sending die-cut opening 50 which pemits viewing of the customer address, part of the formatted customer information 25, which is in register with the sending opening 50 when the outer sheet 21 is folded. Other versions of this embodiment include a cellophane cover (not shown) disposed over the sending opening 50 to better protect the contents of the mailing envelope 11. Still other versions may have no opening, requiring that the customer address be applied by other means, such as manually or by applying a gum type label.

Figure 6:
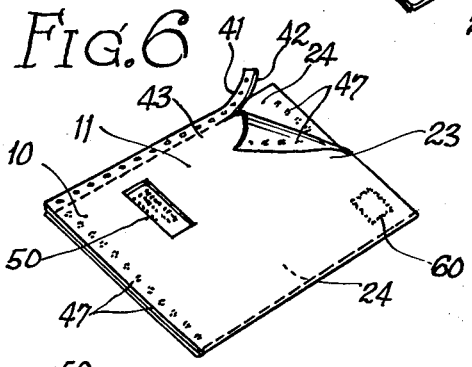
FIG. 6 is a perspective view showing how the mailing envelope is opened.

FIGS. 6 through 9 show the sequence of use, for the improved business form 10. In FIG. 6, the sealed first feed strip 41 and second feed strip 42 are detached at the coincident strip lines of weakening 43. The second side 24 and the first side 23 are then pulled apart breaking the releasable adhesive spot 47 and revealing the inside of the business form 10. If upper and lower adhesive strips (not shown) are used in place of the adhesive spots 47, the upper and lower adhesive strips are detached at the upper and lower lines of weakening (not shown).

Figure 7:
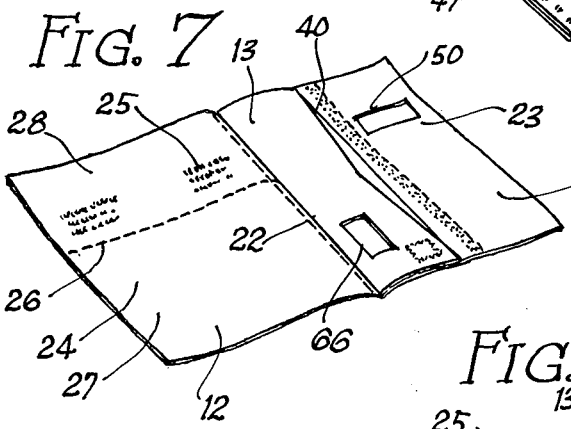
FIG. 7 is a persepctive view of the opened mailing envelope showing the return envelope and customer statement.

FIG. 7 shows the orientation of the various components of the opened improved business form 10. Specifically the customer stub 27 and the return stub 28 of the customer statement 12 are shown as is the return envelope 13 with its sealing flap 40. FIG. 7 also shows the orientation of the sending die-cut opening 50 and a return die-cut opening 66.

Figure 8:
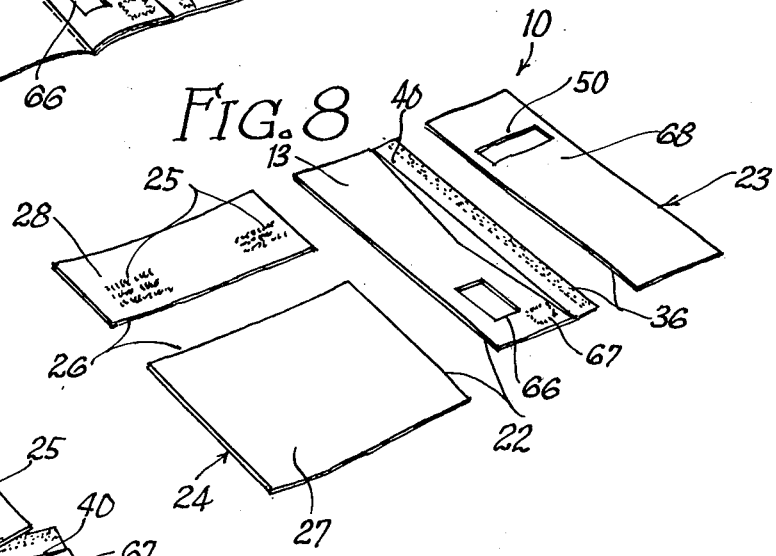
FIG. 8 is a perspective view showing how the return envelope and customer statements are separated.

FIG. 8 shows the first side 23 being separated from the second side along bisecting center line of weakening 22. The second side 24 is further separated along statement line of weakening 26 to form the customer stub 27 and the return stub 28. The first side 23 is divided along return line of weakening 36 to form the return envelope 13 with sealing flap 40 and a remaining portion 68.

Figure 9:
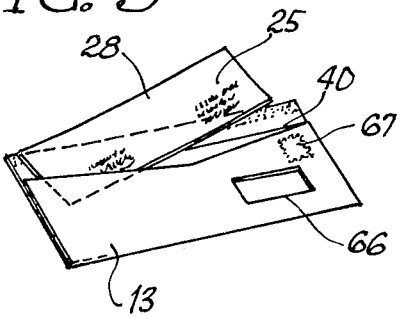
FIG. 9 is a perspective view of the return envelope showing return material being inserted for return mailing.

FIG. 9 shows the return stub 28 being inserted into the return envelope 13 for return mailing. The return envelope 13 sealed with sealing flap 40 is provided with a preprinted return postal stamp 67. The return envelope 13 is also provided with a return die-cut opening 66 which permits viewing of the return address, part of the formatted customer information 25, which is in register with the return opening 66 when the return stub 28 is properly inserted. Other versions of this embodiment include a cellophane cover (not shown) over the return opening 66 to protect the contents of the return envelope 13. Alternatively, the return opening 66 may be omitted requiring the return address to be preprinted, or be applied by other means such as manually or a gum type label. Similarly, the return postal stamp 67 may be applied by other manual means.

Figure 10:
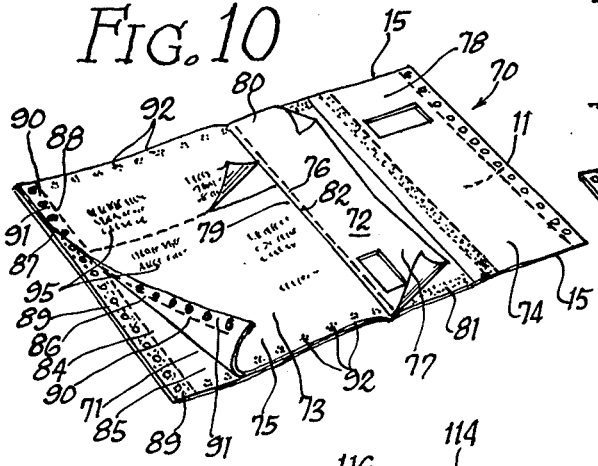
FIG. 10 is a perspective view showing an alternate embodiment of the improved business form, the copy business form.

FIG. 10 shows an alternate embodiment of the improved buisness form, the improved copy business form 70, which includes a mailing envelope 11, a customer statement 71, a return envelope 72, and a copy statement 73. Similar to the improved business form 10 shown in FIG. 1, the improved copy business form 70 is manufactured in continuous series of individual copy business forms 70, each of which is delimited by transverse lines of weakening 15. The improved copy business form 70 is comprised of an outer sheet 74 having a bisecting center line of weakening 79 forming a first side 78, and a second side 85, which is substantially the same as the outer sheet 21 of the improved business form shown in FIG. 1.

The improved copy business form 70 also includes an inner sheet 75 which has a return envelope line of weakening 76 separating the return envelope portion 77 and copy statement 73. The return envelope portion 77 is adhesively secured to the first side 78 of the outer sheet 74 such that the return envelope line of weakening 76 is parallel to and offset slightly in the direction of the first side of the bisecting center line 79 of the outer sheet 74. The return portion 77 is adhesively secured along the return top edge 80, the return bottom edge 81 and the first side edge 82 of the return envelope line of weakening 76.

The copy statement 73 extends from the return envelope line of weakening 76 across the bisecting center line 79 to the second feed strip 84 such that the copy statement is substantially in register with the second side 85. No portion of the copy statement 73 is secured to the second side 85 prior to its subsequent folding.

Figure 11:
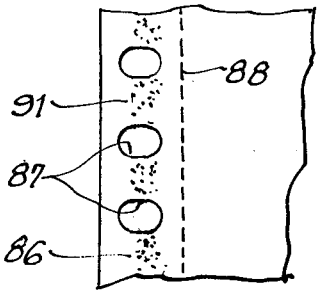
FIG. 11 is a broken plan view of the copy feed strip of the inner sheet of the copy business form.

The copy statement 73 includes a copy feed strip 86, also shown in FIG. 11, having a plurality of elongated feed holes 87 and a copy strip line of weakening 88. The elongated feed holes 87 are aligned with the feed holes 89 in the second feed strip 84 and are elongated to retain this alignment after the outer sheet 74 is subsequently folded. The elongation is required because of the shorter distance taken by the inner sheet 75 than that of the outer sheet 74 during the folding of the outer sheet 74. The copy strip line of weakening 88 is positioned so that it is aligned with the strip line of weakening 90 of second feed strip 84 after the outer sheet 74 has been folded.

Returning to FIG. 10, the copy strip 86 is provided with sealing adhesive strips 91 located on either side of the outer edge of the copy strip 86. Further, the copy statement 73 is provided with a plurality of sealing adhesive spots 92 located on either side of the upper edge and lower edge of the copy statement 73. An appropriate adhesive material is the reheat glue described above.

The inner sheet 75 may be of any suitable material and the copy statement 73 may be specially pre-cut to any shape in order that specific user requirements are satisfied. The customer information 95 is directly printed on the copy statement 73 and transferred to the customer statement 71 through an impact printing transfer means such as carbon backing on the copy statement 73 or through a carbonless printing technique.

The use and operation of the improved copy business form 70 is substantially the same as that of the improved business form 10 shown in FIG. 1. There are analogous provisions for a sealing flap, sending die-cut opening, and return die-cut openings. Also, the folding and sealing operations are analogous. The manner in which the sealed mailing envelope 11 of the improved copy business form 70 is opened is similar. The copy statement 73 is detached after the mailing envelope is opened at return envelope line of weakening 76.

Figure 12:
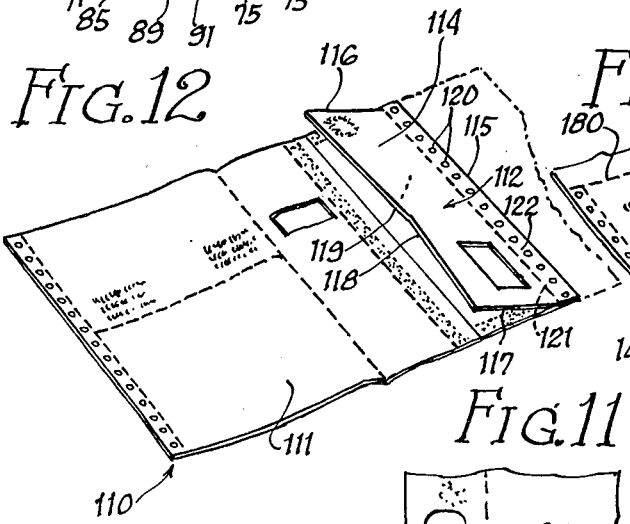
FIG. 12 is a perspective view showing an alternate embodiment of the improved business form, the single sheet business form.

FIG. 12 shows a third alternate embodiment of the improved business form, a single sheet business form 110. In this embodiment the single sheet business form 110 is comprised of an oversized outer sheet 111 which is prefolded such that a fold portion 114 overlaps and is adhesively secured to form a return envelope 112. Specifically, the fold portion 114 is adhesively secured along the fold edge 115 and along the top edge 116 and bottom edge 117 leaving the inside edge 118 open to form a pocket 119 therein. The oversized outer sheet 111 is prepared with punched holes 120 and lines of weakening 121 such that after the fold portion 114 is folded and secured, a first feed strip 122 has aligned feed holes 120 and aligned first edge strip lines of weakening 121. In every other aspect, the structure, operation, and use of the single sheet business form 110 is substantially the same as that of the improved business form 10 shown in FIG. 1.

Figure 13:
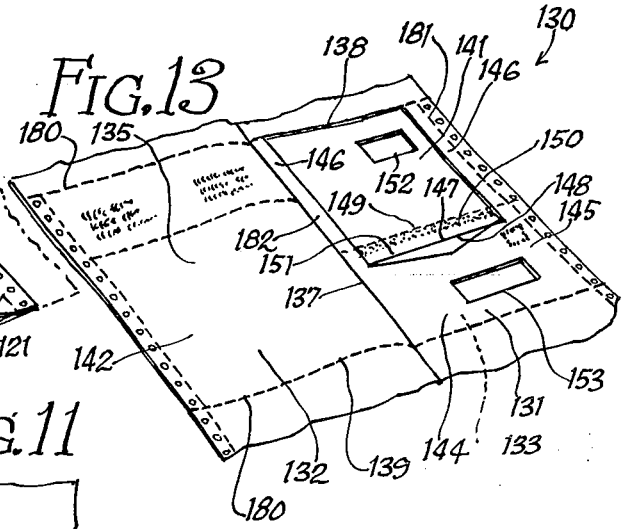
FIG. 13 is a perspective view showing an alternate embodiment of the improved business form, the cross oriented business form.

FIG. 13 shows a fourth alternate embodiment of the improved business form, the cross oriented business form 130, having a transversely oriented return envelope 131. The cross oriented business form 130, including the mailing envelope 133, the customer statement 132, and the return envelope 131, is manufactured in a continuous series of such cross oriented business forms 130. Each cross oriented business form 130 is delimited by transverse lines of weakening 180 to allow preparation on conventional data processing equipment.

The cross oriented business form 130 comprise an outer sheet 135 having a bisecting center line of weakening 137 extending from the top edge 138 to the bottom edge 139 whereby to form a first side 141 and a second side 142. The second side 142 of the cross oriented business form 130 is similar in structure and operation to the second side 24 of the improved business form 10 shown in FIG. 1.

The cross oriented business form 130 also includes an inner sheet 144 which is continuous through the continuous series of cross oriented business forms 130. The inner sheet 144 includes a pocket portion 145 and two trail portions 146 which connect sequential pocket portions 145 at the edges thereof. The inner sheet 144 is secured to the first side 141 of the outer sheet 135 such that the pocket portion is aligned with the bottom edge 139 of the first side 141 with the trail portions 146 extending up along the outside edge 181 of the first side and along the first side edge 182 of the bisecting center line 137. The inner sheet 144 is glued to the outer sheet 135 along the bottom edge 139, and up the outer edge 181 and the first side edge 182 forming the transversely oriented return envelope 131 with its opening at the upper edge 147 of the pocket portion 145. Alternatively, the pocket portion 145 may be secured along the upper edge 138 of the first side 141 having the trail portion 146 extending downward, with the lower edge of the pocket portion being open and thereby forming the return envelope 131. Further, depending upon customer needs, the pocket portion 145 may be positioned at any point up or down the first side 141 of the outer sheet 135.

Features similar to those shown in FIG. 10 may be provided whereby the cross oriented business form 130 would include an additional copy statement. The only limitation is that no glue or method of securing extend across the bisecting center line 137 where the cross oriented business form is subsequently folded to form the mailing envelope 133. The first side 141 is also provided with transversely oriented score lines 148, return line of weakening 149, and return adhesive strip line 150, to form a sealing flap 151 for the transversely oriented return envelope 131.

Similar in structure to the improved business form 10 shown in FIG. 1, the cross oriented business form 130 may be provided with a sending die-cut opening 152 and a return die-cut opening 153. In every other aspect of structure, operation, and use, the cross oriented business form 130 is analogous to that of the improved business form 10 shown in FIG. 1.

Figure 15:
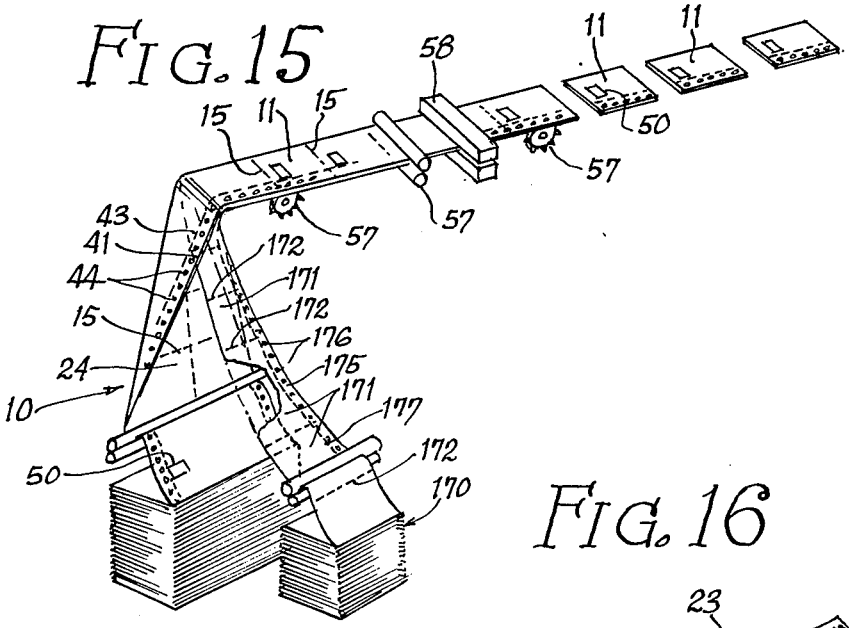
FIG. 15 is a perspective view showing a continuous series of improved business forms having supplemental forms inserted into the mailing envelopes as they are folded, attached and separated.

FIG. 15 shows the basic structure of a continuous series of improved business forms 10 with a continuous series of supplemental business forms 170 being interleaved and inserted between the first and second sides, 23 and 24, respectively, of the mailing envelope 11 of the improved business form 10.

The continuous series of supplemental forms 170 includes a plurality of transverse lines of separation 172 which delimits each supplemental form 171. The supplemental form 171 is adapted to receive statement information, advertising information, or other forms of prepared customer information. The supplemental form 171 size, shape, paper, and print may be uniquely adapted to user requirements.

The embodiment shown in FIG. 15 represents a plane single sheet series of supplemental forms 170. Alternative embodiments include a folded sheet series of supplemental forms (not shown) having a longitudinal fold line or line of weakening and multiple ply series of supplemental forms (not shown) which are inserted into the mailing envelope 11 during the folding and sealing operation. The series of supplemental forms 170 may be pre-die-cut to any shape and specifically to a shape which permits the customer name and address information 25 on the second side 24 of the improved business form 10 to be visible through the sending die-cut opening 50 of the folded mailing envelope.

The series of supplemental forms 170 includes a supplemental feed strip 175 having a plurality of feed holes 176 and a supplemental strip line of weakening 177 which are in register with the first feed strip 41 and the second feed strip 42, the feed holes 44 and the strip line of weakening 43, respectively, when the series of supplemental forms 170 is interleaved and inserted into the folded mailing envelope 11. Each supplemental forms 171 is further provided with an adhesive (not shown), such as the reheat glue described above, along both sides of the supplemental feed strip 175. Further, each of the supplemental forms 171 is provided with a plurality of supplemental adhesive spots, (not shown) which are evenly distributed along both sides of the top and bottom edges of the supplemental form 171.

In practice the prepared continuous series of supplemental forms 170 are simultaneously fed into the advancing means 57 and adhesive activator 58 so that the transverse lines of separation of 172 of supplemental forms 170 are in register with the transverse lines of weakening 15 in the improved business form 10. The adhesive is activated by adhesive activator 58 and individual improved business form 10 with incorporated supplemental form 171 are separated by conventional bursing means (not shown).

The adhesive on both sides of the supplemental form 171 provide a means for substantially sealing the mailing envelope 11. The sealed mailing envelope 11 is opened in the conventional manner by separating the secured first feed strip 41, second feed strip, (not shown), and supplemental feed strip 175 at their respective lines of weakening, then by pulling the first side 23, second side 24, and supplemental form 171 apart by breaking the respective adhesive spots.

Figure 16:
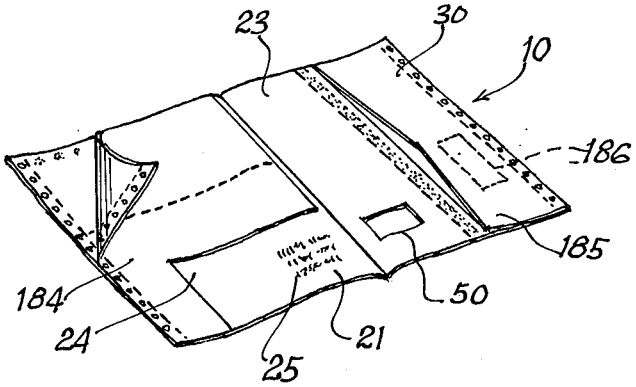
FIG. 16 is a perspective view of an opened mailing envelope showing the supplemental form, the return envelope, and the customer statement.

FIG. 16 shows an opened improved business form 10 having an inserted supplemental forms 184. The improved business form 10 includes a return envelope 185 positioned on the outer edge of the first side 23 of the outer sheet 21. This embodiment further shows the return die-cut opening 186 as being positioned on the outer sheet 21 of the improved business form 10 and not on the inner sheet 30 as shown in the figures above.

The supplemental form 184 includes an appropriate pre-die-cut opening to allow the customer name and address 25 within the customer statement information on the second side 24 to be visible through send-die-cut opening 50 of the folded business form 10.

Figure 17:
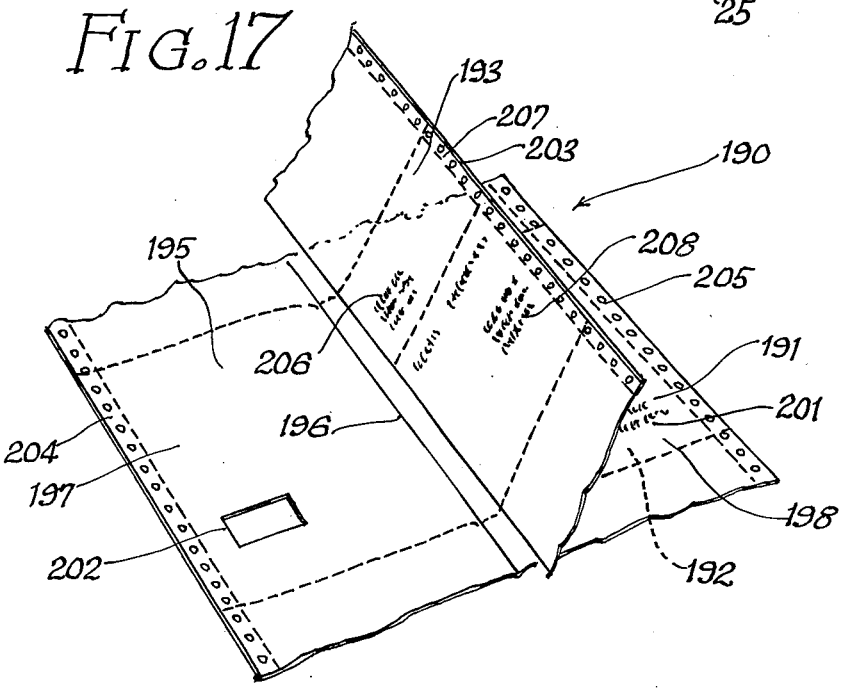
FIG. 17 is a perspective view showing an alternate embodiment of the improved business form, the statement business form, with inserted supplemental form.

FIG. 17 shows an embodiment of an improved statement business form 190 including a customer statement 191, a mailing envelope 192, and a supplemental form 193. This embodiment is intended for those applications of the improved business form 190 which do not require a return mailing and therefore does not provide a return envelope. The structure of the improved statement business form 190 is analagous to that of the improved business form 10 shown in FIG. 1.

The improved statement business form 190 includes a continuous outer sheet 195 having a bisecting center line 196 which forms a first side 197 and a second side 198. Second side 198 is adapted to receive customer statement information 201 or other customer information whereby to form the customer statement 191. The first side includes a sending die-cut opening 202.

Similar to the process shown in FIG. 15, the supplemental form 193 may be interleaved between the first side 197 and the second side 198 of the folded outer sheet 195 as the mailing envelope 192 is being prepared. The supplemental form 193 includes a supplemental feed strip 203 which is in register with the first feed strip 204 and the second feed strip 205 on the first side 197 and second side 198, respectively, of the folded mailing envelope 192. The supplemental form 193 is further provided with an appropriate adhesive 207 on both sides of the outer edges of the supplemental form 193 to provide a means for releasably securing the folded mailing envelope 192. The supplemental form 193 is adapted to receive statement information 206 or other customer information so that the customer name and address 208 which may be applied to the supplemental form 193 is visible through the sending die-cut opening 202 of the folded mailing envelope 192 when the supplemental form 193 is inserted. Alternatively, the supplemental form 193 may be pre-die-cut or may be omitted to allow the customer name and address within the customer statement information 201 on the second side 198 to be visible through the sending die-cut opening 202 of the folded mailing envelope 192.

Generally with regard to the structure of my invention a plurality of copy statements may be included providing that no glue line or method of attaching extends across the bisecting center line, that line on which the business form is folded. Either side of my invention may be designated the first or second side in that my invention is independent of such a distinction. The outer sheet, inner sheet, and any additional copy statements may be pre-printed on one or both sides with standard form information as the user's requirements dictate.

It is understood that the description of my invention is done to fully comply with the requirements of 35 USC 112 and it is not intended to limit my invention in any way. It can be seen from the above description that variant forms of the improved business form can easily be developed. Therefore, such variant forms are considered to be within the scope and essence of this invention.

What is claimed is:

1. A continuous series of improved Business Forms comprising: a plurality of similar improved Business Forms, having integral mailing envelopes, customers statement, and return envelope, delimited by a plurality of transverse tear perforations; each of said improved Business Forms comprising: an outer sheet having a longitudinal releasable center line of weakening whereby to form a first side and a second side, said second side being adapted to receive formatted statement information whereby to form said customer statement, an inner sheet having a portion thereof parallel to and adjacent to said center line, means for securing said inner sheet only to said first side whereby no part of said inner sheet is secured to said second side, said outer sheet and secured inner sheet forming said return envelope, said outer and secured inner sheet being adapted for folding along said center line, and means for releasably securing the outer edges of the mating surfaces of said first side and said second side whereby to form said mailing envelope, said first side having a sending die-cut opening, said formatted statement information including a customer name and address is positioned so that the customer name and address is in register with and visible through said sending die-cut opening in said first side of said outer sheet of said folding mailing envelope.

2. A continuous series of improved Business Forms comprising: a plurality of similar improved Business Forms having integral mailing envelope, customer statement, and return envelope, delimited by a plurality of transverse tear perforations; each of said improved Business Forms comprising: an outer sheet having a longitudinal releasable center line of weakening whereby to form a first side and a second side, said second side being adapted to receive formatted statement information whereby to form said customer statement, an inner sheet having a portion thereof parallel to and adjacent said center line, means for securing said inner sheet only to said first side whereby no part of said inner sheet is secured to said second side, said outer sheet and secured inner sheet forming said return envelope, said outer sheet and secured inner sheet being adapted for folding along said center line, and means for releasably securing the outer edges of the mating surfaces of the first side and said second side whereby to form said mailing envelope, said inner sheet including a pocket portion and two trail portions extending from opposite edges of said pocket portion, and trail portions extending parallel up from the pocket portion, said inner sheet being secured to said first side so that the bottom of the pocket portion is secured to the bottom of the first side, the center edge of the pocket portion and the corresponding trail portion are attached to the first side edge of the center line, and the outside edge of said pocket portion and corresponding trail portion are attached to the outer edge of the first side, and said first side further comprising a transverse return line of weakening parallel to and away from the open edge of the attached pocket portion, and a return adhesive means positioned intermediate said open edge and said return line of weakening.

3. A continuous series of improved Business Forms for preparation on data processing equipment wherein statement information is directly printed on each business form, said continuous series of improved Business Forms comprising: a continuous outer sheet having a longitudinal releasable center line of weakening dividing said outer sheet into a first side and a second side; a continuous inner sheet longitudinally superimposed in partial registry over said first side of said outer sheet, said inner sheet having a portion thereof parallel to and adjacent to said center line; a plurality of spaced transversed lines of weakening extending across said outer sheet and said inner sheet whereby to form at least one improved Business Form having integral therewith a mailing envelope, a customer statement, and a return envelope; means for securing said inner sheet only to said first side of said outer sheet of said improved Business Form whereby no part of said inner sheet is secured to said second side, said outer sheet and secured inner sheet forming a return pocket having an open edge; a return line of weakening parallel to and away from the open edge of said inner sheet; a return adhesive means positioned intermediate said return line of weakening and the open edge of the inner sheet whereby to form a sealing flap, said sealing flap and said return pocket forming said return envelope; said second side of said outer sheet being adapted to receive formatted customer statement information whereby to form said customer statement; said outer sheet and said secured inner sheet being adapted for longitudinal folding along said center line; means for releasably securing the outer edges of the mating surfaces of said first side and said second side to form said mailing envelope, whereby said mailing envelope may thereafter be reopened by releasing said releasably securing means, and said customer statement and said return envelope may thereafter be separated by separating said center line and said return line of weakening; a sending die-cut opening in said first side wherein said formatted statement information including a customer name and mailing address is positioned so that the customer name and address is in register with and visible through said sending die-cut opening in said first side of said outer sheet of said folded mailing envelope.

* * * * *